US012680427B2

(12) United States Patent
Setiadi et al.

(10) Patent No.: US 12,680,427 B2
(45) Date of Patent: Jul. 14, 2026

(54) PRODUCTION METHOD WITH A PLUNGER LIFT SYSTEM

(71) Applicant: Saudi Arabian Oil Company, Dhahran (SA)

(72) Inventors: Bagus Wahyu Setiadi, Dhahran (SA); Gustavo Ariel Alvarez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 125 days.

(21) Appl. No.: 18/523,293

(22) Filed: Nov. 29, 2023

(65) Prior Publication Data

US 2025/0172057 A1 May 29, 2025

(51) Int. Cl.

| | |
|---|---|
| ***E21B 43/12*** | (2006.01) |
| ***E21B 47/008*** | (2012.01) |
| ***E21B 47/09*** | (2012.01) |
| ***F04B 47/12*** | (2006.01) |
| ***F04B 49/06*** | (2006.01) |

(52) U.S. Cl.

CPC ..... *E21B 43/121* (2013.01); *E21B 47/008* (2020.05); *E21B 47/09* (2013.01); *F04B 47/12* (2013.01); *F04B 49/065* (2013.01)

(58) Field of Classification Search

CPC ..... E21B 43/121; E21B 47/008; E21B 47/09
See application file for complete search history.

(56) References Cited

U.S. PATENT DOCUMENTS

| | | | | |
|---|---|---|---|---|
| 2,676,547 A | | 4/1954 | Knox | |
| 5,429,190 A | * | 7/1995 | Kilgore | E21B 47/092 166/66.4 |
| 6,571,868 B2 | | 6/2003 | Victor | |

(Continued)

FOREIGN PATENT DOCUMENTS

| | | |
|---|---|---|
| CA | 2164145 | 11/1996 |
| CA | 2527012 | 11/2005 |

(Continued)

OTHER PUBLICATIONS

Gray, "Well-Performance Diagnostics Using Smart Plunger Technology," SPE 120596-MS, SPE International, SPE Production and Operations Symposium, Oklahoma City, Oklahoma, Apr. 2009, 10 pages.

(Continued)

*Primary Examiner* — Catherine Loikith
(74) *Attorney, Agent, or Firm* — Fish & Richardson P.C.

(57) ABSTRACT

A method includes deploying a plunger from a wellhead to a downhole location of a production string fluidly coupled to the wellhead and disposed within a wellbore. The plunger includes a collar detector attached to a body of the plunger and the production string includes a plurality of collar. The method includes detecting, by the collar detector, the plurality of collars as the plunger moves along the string, generating, by a circuitry module of the collar detector, a first plurality of timestamps each associated with a respective collar. The method also includes determining, as a function of the timestamps, at least one parameter of the plunger, and controlling, as a function of the parameter of the plunger, a valve fluidly coupled to the wellhead to control a parameter of a plunger lift cycling operation.

18 Claims, 6 Drawing Sheets

(56) References Cited

U.S. PATENT DOCUMENTS

| | | | | |
|---|---|---|---|---|
| 6,634,426 | B2 * | 10/2003 | McCoy | E21B 47/008 137/487 |
| 7,954,545 | B2 | 6/2011 | Hearn et al. | |
| 8,286,717 | B2 | 10/2012 | Giroux et al. | |
| 9,109,424 | B2 | 8/2015 | Jefferies et al. | |
| 9,587,444 | B2 | 3/2017 | Agarwal | |
| 9,915,256 | B2 | 3/2018 | Bebak et al. | |
| 9,976,399 | B2 * | 5/2018 | Tolman | E21B 23/08 |
| 10,697,287 | B2 | 6/2020 | Romer et al. | |
| 12,371,977 | B2 * | 7/2025 | Setiadi | E21B 43/121 |
| 2010/0038071 | A1 | 2/2010 | Scott et al. | |
| 2015/0275633 | A1 | 10/2015 | Tolman et al. | |
| 2017/0044882 | A1 | 2/2017 | Casey et al. | |
| 2017/0183946 | A1 | 6/2017 | Tolman et al. | |
| 2018/0058191 | A1 | 3/2018 | Romer et al. | |
| 2018/0196005 | A1 | 7/2018 | Fanini et al. | |
| 2022/0372852 | A1 | 11/2022 | Schmidt et al. | |

FOREIGN PATENT DOCUMENTS

| | | |
|---|---|---|
| CN | 2336113 | 9/1999 |
| CN | 201314221 | 9/2009 |
| CN | 203035167 | 7/2013 |
| CN | 203603854 | 5/2014 |
| CN | 205189837 | 4/2016 |
| CN | 109209305 | 1/2019 |
| CN | 216406782 | 4/2022 |
| EP | 0651132 A2 | 5/1995 |
| EP | 2142755 | 3/2016 |
| GB | 2257185 | 1/1993 |
| GB | 2409691 | 2/2007 |
| GB | 2452370 | 3/2009 |
| WO | WO 2015167895 | 11/2015 |
| WO | WO 2016057011 | 4/2016 |

OTHER PUBLICATIONS

International Search Report and Written Opinion in International Appln. No. PCT/US2024/057022, mailed on Feb. 10, 2025, 15 pages.

* cited by examiner

PRODUCTION METHOD WITH A PLUNGER LIFT SYSTEM

TECHNICAL FIELD

This disclosure relates to oil and gas production systems, and more particularly to plunger lift systems.

BACKGROUND

Plunger lift systems are used to produce hydrocarbons and deliquefy natural gas wellbores. Plunger lift systems use one or more plungers that are moved up and down along a wellbore by the natural pressure of the well or by injecting fluid from the surface of the wellbore to lift hydrocarbons accumulated above the plunger. Methods and equipment to improve plunger lift systems are sought.

SUMMARY

Implementations of the present disclosure include a method that includes deploying a plunger from a wellhead to a downhole location of a production string fluidly coupled to the wellhead and disposed within a wellbore. The plunger includes a collar detector attached to a body of the plunger and the production string including a plurality of collars spaced apart and distributed along a length of the production string, each collar joining two adjacent pipes of the production string to form a joint. The method also includes detecting, by the collar detector, the plurality of collars as the plunger moves in a downhole direction, the detecting including generating, by a circuitry module of the collar detector, a first plurality of timestamps each associated with a respective collar. The method also includes lifting the plunger from the downhole location of the production string to the wellhead to produce hydrocarbons. The method also includes detecting, by the collar detector, the plurality of collars as the plunger moves in an uphole direction, the detecting including generating, by the circuitry module of the collar detector, a second plurality of timestamps each associated with a respective collar. The method also includes determining, as a function of the first and second plurality of timestamps, at least one parameter of the plunger, and controlling, as a function of the parameter of the plunger, a valve fluidly coupled to the wellhead to control a parameter of a plunger lift cycling operation.

In some implementations, the collar detector includes an electromechanical collar detector including a plurality of spring-loaded pins connected to an electromechanical transducer configured to generate, in response to movement of the plurality of spring-loaded pins, the first plurality of timestamps and store the plurality of timestamps in a memory of the plunger, and detecting the plurality of collars as the plunger moves in a downhole direction includes axially extending, at an annular section of increased diameter at the respective joint, the plurality of spring-loaded pins as the plunger moves past each collar.

In some implementations, the method further includes, before determining the at least one parameter of the plunger, transmitting, by a transmitter of the plunger, the first and second plurality of timestamps to a system including one or more computer in one or more location, wherein the determining includes determining, by the system and as a function of the plurality of timestamps a falling speed of the plunger.

In some implementations, the determining includes determining the falling speed of the plunger between two consecutive collars. The determining includes determining, by the system, a time period between the two consecutive collars, and dividing, by the processing device, a prerecorded distance between the two consecutive collars by the time period.

In some implementations, the determining includes determining a change of falling speed of the plunger and determining, as a function of the change of falling speed, a fluid level of fluid accumulated at a downhole end of the production string.

In some implementations, one of the plurality of spring-loaded pin is a downward facing spring-loaded pin at a lowermost end of the plunger, the downward facing spring-loaded pin configured to retract upon contact with a bottom hole bumper spring of the production spring, the electromechanical transducer configured to generate, in response to the retraction of the downward facing spring-loaded pin, a timestamp that represents a time at which the plunger lands at the bottom hole bumper spring.

In some implementations, the controlling includes controlling a time that the valve is open to decrease or increase a shut-in time of the plunger lift cycle operation to change a production rate of the wellbore.

In some implementations, the plurality of spring-loaded pins include a plurality of spring-loaded plungers.

In some implementations, the determining includes determining a change of falling or rising speed of the plunger and a location of the falling or rising speed of the plunger and determining, as a function of the change and location of the falling or rising speed, a sealing performance of the plunger.

In some implementations, the at least one parameter of the plunger includes at least one of a falling velocity of the plunger, a falling acceleration of the plunger, a rising velocity of the plunger, a rising acceleration of the plunger, a location of the plunger along the production string, or a location of the plunger within the wellhead.

In some implementations, the valve includes a control valve and the parameter of the subsequent plunger lift cycling operation includes at least one of a shut-in time or an after-flow time, the controlling including controlling a time that the control valve is open to change the shut-in time or the after-flow time and thus change the rate of production of the wellbore.

Implementations of the present disclosure include a method that includes receiving, by a system including one or more computers in one or more locations, information from a collar detector attached to a plunger configured to move along a production string to produce hydrocarbons during a plunger lift cycle operation. The production string is fluidly coupled to a wellhead including a valve and includes a plurality of collars spaced apart and distributed along a length of the production string, each collar joining two consecutive pipes of the production string, the information including a plurality of timestamps each associated with a time at which the collar detector detects a respective collar. The method also includes determining, by the system and as a function of the information, a parameter of the plunger during the plunger lift cycle operation, and controlling, by the system and as a function of the determined parameter, the valve to change at least one parameter of the plunger lift cycle operation.

In some implementations, the collar detector includes a housing attached to a downhole end of the plunger, a memory disposed within the housing, a transducer disposed within the housing, and multiple spring-loaded pins connected to the transducer and extending through a side wall of the housing. The transducer generates, in response to movement of the plurality of spring-loaded pins, the plurality of timestamps and store the plurality of timestamps in the memory, and detecting the plurality of collars as the plunger moves in a downhole direction includes axially extending, at an annular section of increased diameter at the respective collar, the plurality of spring-loaded pins as the plunger moves past each collar.

In some implementations, the method further includes, before determining the parameter of the plunger, transmitting, by a transmitter of the collar detector, the plurality of timestamps to a system at a terranean surface of the wellbore and including one or more computer in one or more location, wherein the determining includes determining, by the system and as a function of the information, a velocity and velocity distribution of the plunger along the production string.

In some implementations, the determining includes determining the falling speed of the plunger between two consecutive collars, the determining including determining, by the system, a time period between the two consecutive collars, and dividing, by the processing device, a prerecorded distance between the two consecutive collars by the time period.

In some implementations, the determining includes determining a change of falling speed of the plunger and determining, as a function of the change of falling speed, a fluid level of fluid accumulated at a downhole end of the production string.

In some implementations, one of the plurality of spring-loaded pin is a downward facing spring-loaded pin at a lowermost end of the plunger, the downward facing spring-loaded pin configured to retract upon landing at a bottom hole bumper spring of the production spring, the electromechanical transducer configured to generate, in response to the retraction of the downward facing spring-loaded pin, a timestamp that represents a time at which the plunger landed at the bottom hole bumper spring.

In some implementations, the controlling includes controlling a time that the valve is open to decrease or increase a shut-in time of the plunger lift cycle operation to change a production rate of the wellbore.

Implementations of the present disclosure include a plunger lift system, including a production string configured to be disposed within a wellbore, the production string made of a plurality of pipes joined by a plurality of collars, a wellhead configured to reside at a terranean surface of the wellbore and be fluidly coupled to the production string, a valve configured to be fluidly coupled to the wellhead, a plunger configured to move along the production string to produce hydrocarbons during a plunger lift cycle operation, the plunger including a collar detector, and a system at or near the terranean surface of the wellbore. The system includes one or more computers in one or more locations. The system is configured to receive, from the collar detector, information including a plurality of timestamps each representing a time at which the collar detector detected a respective one of the plurality of collars, and determine, as a function of the information, a parameter of the plunger, the parameter including at least one of a speed or location of the plunger along the production string, the parameter usable to control the at least one parameter of the plunger lift cycle operation.

In some implementations, the system includes a controller configured to control, as a function of the determined speed of the plunger, the valve to change at least one of a shut-in period or an after-flow period of the plunger lift cycle operation.

Particular implementations of the subject matter described in this specification can be implemented so as to realize one or more of the following advantages. For example, the plunger lift system of the present disclosure enables the use sensors and collar detectors to optimize the plunger lift cycle and increase the rate of production. Additionally, the plunger lift system of the present disclosure can help prevent damage to the lubricator and allows early detection of issues with the equipment, which can help save time and resources.

DETAILED DESCRIPTION OF THE DISCLOSURE

Plunger lift systems use a form of intermittent gas lift method that includes using gas pressure buildup in the casing-tubing annulus to push a plunger up from the bottom of the plunger. The plunger is dropped from the terranean surface of the wellbore and falls through the fluid accumulated at the bottom of the production string until the plunger lands at the lower spring assembly of the plunger lift system. When the plunger is pushed uphole from the lower spring, the plunger lifts the fluid accumulated above the plunger to the terranean surface. Once the fluid is flowed out of the wellbore, the annulus is depressurized, and the plunger falls downhole to repeat the process.

The present disclosure describes a smart plunger lift system that included a production string made of multiple pipes attached by tubular collars. The collars can be detected by the plunger (e.g., a collar detector attached to plunger) or by a sensor (e.g., an RFID reader). For example, the plunger can have a collar detector that detects variations in the inner diameter of the tubing at each collar connection to count or detect and record each collar connection as the plunger moves along the tubing. In some aspects, the plunger has an RFID reader that detects RFID tags attached to each collar. The system also includes a lubricator with an RFID tag and a bumper spring assembly with an RFID tag. In some aspects, the computed system processes the data received from the plunger and controls, as a function of the data, the plunger lift process. For example, the computer determines, based on the information received from the plunger, the velocity, location, and other parameters of the plunger during the plunger lift cycle. The computer transmits instructions to a controller that controls valves and/or pumps that control the shut in time, pressure, and other parameters to optimize the plunger lift cycle.

Figure 1:
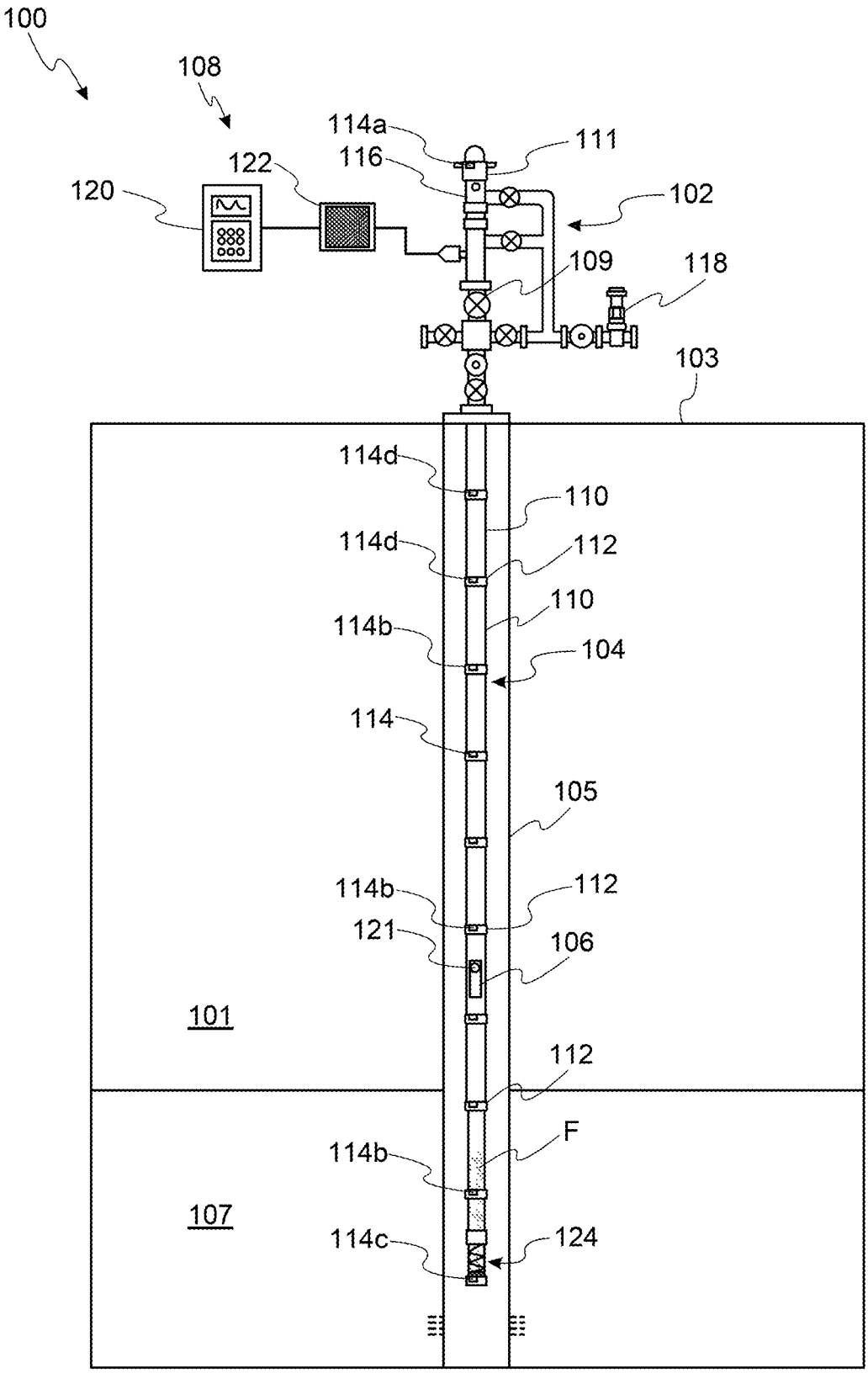
FIG. 1 shows a front, partial cross-sectional view of an example well system.

FIG. 1 shows a plunger lift system 100 that includes a wellhead assembly 102, a production string 104, a plunger 106, and a computer-implemented system 108. The production string 104 is disposed within a wellbore 105 (e.g., a production wellbore) that is used to produce trapped hydrocarbons from a reservoir 107. The reservoir can reside in one or multiple subterranean formations 101 (e.g., a geologic formation). The wellbore 105 extends down from a terranean surface 103 into the geologic formation 101.

In some aspects, the wellhead assembly 102 resides at the terranean surface 103 and includes a wellhead 109 and a lubricator 111 coupled to the wellhead 109. The wellhead 109 resides at or near the terranean surface 103 of the wellbore 105, and is the lowermost part of the wellhead assembly 102. In some aspects, the wellhead 109 includes wellhead components (not shown) such as a casing head, a conductor casing, a tubing spool, casing hangers, etc.

In some aspects, the lubricator 111 is attached to and disposed above the wellhead 109. The lubricator assembly 111 can be attached to the wellhead 109 through a flange (e.g., a bolted flange). The lubricator 111 has a tubular housing 116 that receives the plunger 106 and the production fluid such from the production string 104. The lubricator 111 serves as the impact tool for the plunger 106 when the plunger 106 arrives at the surface. The lubricator 111 has at least one inlet (not shown) that receives lubricant to lubricate the components and plunger 106 as needed. In some aspects, once the plunger 106 arrives at the lubricator 111, a catcher (not shown) of the lubricator catches the plunger 106, preventing the plunger 106 from falling downhole.

The wellhead assembly 102 includes a valve 118 (e.g., a control valve) that regulates the pressure of the production string 104. For example, when the control valve 118 closes, the flow in the production string 104 stops and the plunger 106 drops from the lubricator, through production fluid "F" (e.g., emulsion) to the bottom of the string 104. With the well shut in, the pressure builds until the valve 118 opens, allowing the plunger 106 to return while pushing the fluid "F" that is above the plunger 106 to the surface 103.

In some aspects, the production string 104 includes multiple pipes 110 and collars 112 joining the pipes 110. In some aspects, the pipes are made of API tubing such as 8 round external-upset-end tubing (i.e., API tubing 8RD EUE). The tubular collars 112 form standard tubing connections such as API 8RD connections. During the run in hole operation, the depth of the collars 112 is recorded in the tubing tally and the depth information stored in a memory of the computer system 108. The production string 104 includes a bottom hole bumper spring (BHBS) 124 that serves as a damper to absorb the energy from the impact of the plunger 106.

In some aspects, the computer system 108 includes a controller 120 and one or more computers 122 (e.g., an edge computer). The computer 122 and controller 120 can be separate or together (e.g., within the same housing). The computer system 108 can be implemented as a distributed computer system disposed partly at the surface 103 and partly within the wellbore 105.

In some aspects, the system 108 use artificial intelligence such as machine-learning algorithms to determine the parameter of the plunger and determine which parameter of the lift cycle to change. For example, the computer 122 can use a machine-learning process (e.g., a deep learning process implemented, for example, using a similarity metric or a classifier such as support vector machine or a neural network) to determine the parameter of the plunger and determine how to control the valve to change the shut-in time or after-flow time (or speed of the plunger) as needed. Thus, the computer 122 can use machine-learning processes to fine tune and more accurately determine the accumulated fluid level and the plunger's velocity, change in velocity, and location (as well as the lift cycle parameter).

In some aspects, the computer 122 is or includes an edge device that serves as the interface between a remote network (e.g., a data center, a cloud, etc.) and the plunger system components, including the plunger transmitter, the controller, and other sensors of the system. For example, the edge device includes a one or more processors that analyze large amounts of data received from the plunger, wellhead, and other components in real-time or near real-time.

As used herein, the term "real-time" refers to transmitting or processing data without intentional delay given the processing limitations of a system, the time required to accurately obtain data, and the rate of change of the data. Although there may be some actual delays, the delays are generally imperceptible to a user.

As further described in detail below with respect to FIG. 9, the computer system 108 includes one or more processors and a computer-readable medium storing instructions executable by the one or more processors to perform the operations described here. In some implementations, the controller 120 can be implemented as processing circuitry, firmware, software, or combinations of them. The controller 120 transmits signals to the valve 118 to operate the valve to either reduce the arrival speed of the plunger 106 or optimize the next plunger lift cycle operation, e.g., change the shut-in time or after flow time of the operation.

In some aspects, the plunger lift system 100 has multiple sensors 114, and the sensor 121 of the plunger 106 senses the sensors 114 as the plunger moves during the plunger lift cycle. Each sensor 114 is attached to or near a respective collar 112 of the production string 104. For example, each sensor 114 is attached to some or all of the collars 112 of the production string 104. The sensors 114 can be, for example, radio frequency identification (RFID) tags, and the plunger sensor 121 can be an RFID reader. The RFID reader 121 interrogates each RFID tag 114 as the plunger moves past each RFID tag 114.

The RFID tags 114 include passive RFID tags **114*b* distributed along the length of the production string 104. The system 108 know the location (e.g., depth) of each RFID tag 114. The system 108 processes the information gathered by the RFID reader 121 to determine one or more parameters (e.g., the speed and location) of the plunger 106 within the production string 104 or the wellhead 109. In some aspects, the lubricator 111 also has an RFID tag 114*a* and the BHBS 124 (or a section of the string near the BHBS) also has an integrated RFID tag 114*c*. For example, the BHBS 124 can be equipped with a passive RFID tag 114*c*** attached to the landing nipple.

In some aspects, to optimize the plunger lift cycle operation, the system 108 uses the location information of each RFID tag 114 and the sensor feedback received from the plunger 106 to determine whether the shut-in time or after flow time of the operation needs to be adjusted.

Figure 2:
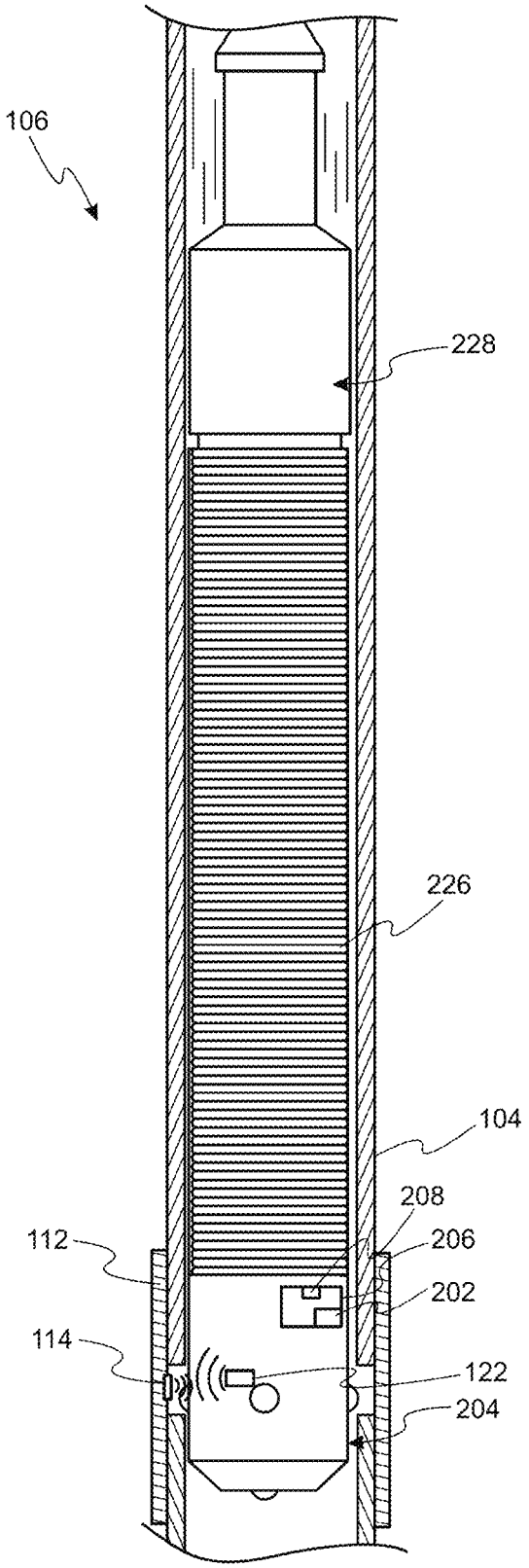
FIG. 2 shows a front, partial cross-sectional view of an example plunger assembly.

For example, as shown in FIG. 2, the RFID reader 121 transmits, as the plunger falls or rises in the production string 104, multiple timestamps to a memory 202 that stores the timestamps. For example, as the RFID reader 121 passes through each RFID tag 114, the RFID reader 121 interrogates the respective RFID tag 114 to generate a unique timestamp associated with each RFID tag 114. In some aspects, interrogating the RFID tags 114 refers to sending a radio wave to the tag 114, energizing the tag 114, and receiving a radio signal from the tag 114 generated in response to energizing the tag 114. The signal can include a unique identifier of the RFID tag 114, and the timestamp generated by the RFID reader can include a time at which the RFID reader 121 received the signal from the tag 114 and the unique identifier of the tag 114. As further described in detail below with respect to FIGS. 3-8, the plunger 106 can alternatively (or in addition to the RFID reader 121) include a collar detector 204 (e.g., a collar counter) that counts or detects each collar 112 along the production string 104.

In some aspects, the memory 202 is part of a circuitry module 206 or electronics hub that includes a wireless transmitter 208 and other components such as a processor, a receiver, etc. The wireless transmitter 208 transmits the timestamp information to the computer system 108 (shown in FIG. 1) while the plunger 106 is in the production string 104 or when the plunger arrives at the surface 103.

Referring also to FIG. 1, the plunger 106 (e.g., the plunger transmitter 208) transmits the sensor feedback (e.g., timestamps) to the computer 122. The computer 122 then determines, as a function of the timestamps, the level of the accumulated fluid and the velocity distribution and location of the plunger. For example, the computer 122 determines parameters that include one or more of: (i) a falling speed of the plunger, (ii) a change of falling speed (e.g., falling acceleration) of the plunger and the location of the change of falling speed, (iii) a falling speed of the plunger between two (e.g., each pair) consecutive RFID tags, (iv) a rising speed of the plunger, (v) a change of rising speed (e.g., a rising acceleration) of the plunger and the location of the change of rising speed, (vi) a rising speed of the plunger between two consecutive RFID tags, and (vii) a real-time location of the plunger along the production string 104.

The computer 122 determines the velocity of the plunger 106 by determining the quotient of a distance divided by a time during which the plunger 106 traveled that distance. For example, the computer 122 first determines a difference between two timestamps (e.g., recorded times) of two consecutive RFID tags 114. That difference represents a time period during which the plunger 106 traveled between the two consecutive RFID tags 114. Then, the computer 122 divides a prerecorded distance between the two consecutive RFID tags by the determined time period. The result is the velocity (or an average or approximate velocity) of the plunger 106 between the two consecutive RFID tags 114. The distance between the two RFID tags can be recorded during the run-in hole operation as the depth of the collars 112 is recorded in the tubing tally.

The parameter of the plunger 106 is used by the computer 122 (or an operator) to change at least one parameter of the plunger lift cycle operation or to reduce the arrival speed of the plunger 106. For example, the computer 122 determines, based on the change of the falling velocity of the falling plunger 106, the fluid level of the fluid "F" accumulated at the bottom of the production string 104. Then, the computer 122 transmits information to the controller 120 to cause the controller 120 to control the valve 118 to change the shut-in time based on the fluid level of the accumulated fluid "F."

In some aspects, the plunger lift cycle begins with the control valve 118 closing, and ends when the after flow time ends. For example, the plunger lift cycle includes closing the valve 118 to initiate the pressure build up and allow the plunger 106 to fall to the bottom (also referred to as the plunger fall time), allowing more downhole pressure to build up if necessary (also referred to as the shut-in time), opening the valve 118 to allow the plunger to rise and produce hydrocarbons (also referred to as the plunger rise time, or the flow time), and, if necessary, allowing the well to continue to produce after the plunger arrived at the lubricator (also referred to as an after-flow time). As the after-flow time ends, the control valve 118 is closed, and a new plunger cycle begins.

The shut-in time (also known as the build-up time) is the time during which the wellbore 105 is allowed to continue to build downhole pressure after the plunger fall time has elapsed. This is normally an optimization period where the pressure shut-in time is balanced with the necessary requirement of energy to ensure a plunger arrival. Too much shut-in time slows down production, and a shut-in time that is too short may not allow enough pressure to build up to lift the plunger 106 to the surface 103.

The after-flow time is the time during which the well is allowed to produce until a load of liquid is developed at the bottom of the tubing. The after-flow period begins when the plunger 106 arrives at the surface 103. When the plunger 106 arrives at the surface 103, the catcher of the lubricator 111 can catch the plunger 106 to prevent the plunger 106 from falling downhole. The valve 118 remains open to allow fluid that was below the plunger 106 to flow up the tubing to the surface and down the flow line. In some cases, additional liquid will be produced with the gas, if the gas velocity in the tubing is high enough to lift liquid to the surface. As the gas rate decreases, liquids are not carried to the surface 103 because the gas velocity becomes too low and the liquid "F" starts to accumulate at the bottom of the tubing 104. If the after-flow period is too short, not enough liquid is brought to the tubing, and if it is too long, the liquid accumulation at the bottom of the tubing can be too much, causing the pressure at the bottom of the well to build-up and reduce the flow from the formation. Excessive liquid accumulation also requires the shut-in time to be longer so that enough pressure builds up to bring the plunger 106 and liquid "F" to the surface.

The velocity of the plunger near the surface 103 is the velocity with which the plunger 106 arrives at the lubricator 111. If the velocity of the plunger 106 is too high, the impact energy of the plunger 106 can break or damage the lubricator 111.

To optimize the shut-in time of the plunger cycle, after-flow time of the plunger cycle, or velocity of the plunger, the computer 122 uses the data received from the plunger 106 to open or close the control valve 118 (or other valves or surface pumps) as necessary.

For example, a lift cycle operation begins by the computer 122 recording the time at which the plunger 106 is dropped. As the plunger 106 travels downhole, the plunger 106 records the signals from the RFID tags 114 and records in its memory the respective timestamps associated with each RFID tag. The plunger 106 also records the time when the plunger 106 reaches the BHBS 124 (by detecting the RFID tag 114*c* at the BHBS 124.

After the plunger 106 arrives at the BHBS 124, the system 108 either opens the valve 118 to lift the plunger 106, holds the valve 118 closed for a predetermined shut-in period, or determines, based on sensor feedback from a downhole pressure sensor, a shut-in period is needed (and, in some cases, the duration of the shut-in period).

After the shut-in period, the controller 120 opens the valve 118, which allows the pressurized fluid at the bottom to push the plunger 106 (and liquid accumulated above the plunger) upwards. The computer 122 records the time at which the valve 118 is opened. As the plunger 106 is pushes uphole, the RFID reader 121 detects when the plunger 106 leaves the BHBS 124 by interrogating the lowermost RFID tag 114*c*. As the plunger 106 rises, the plunger 106 records, based on the signals received from the RFID tags 114*b*, the respective timestamps associated with the time at which the RFID reader 121 records the signal from each RFID tag 114*b*.

When the plunger 106 reaches the lubricator 111, the RFID reader 121 detects the RFID tag 114*a* attached to the lubricator 111. The computer 122 records the arrival time of the plunger 106. In some cases, an arrival sensor (not shown) detects the plunger 106 and transmits the information to the controller 120 to cause the controller to actuate a catcher to catch the plunger 106.

Once the plunger 106 is inside the lubricator 111 (or as the plunger 106 approaches the surface 103), the computer 122 receives the timestamp information from the RFID reader 121. For example, a data logger of the computer 122 interrogates the RFID reader 121, which causes the RFID reader 121 to wirelessly transfer the data recorded during the fall and rise of the plunger 106. The computer 122 processes the information received from the plunger 106 to determine the liquid level of the accumulated liquid "F" and the velocities of the plunger.

The computer 122 uses the determined parameters to at least one of: (1) change the shut-in time for the next cycle (ii) change the after-flow time for the next cycle, (iii) slow down the plunger velocity, (iv) and detect anomalies. The computer 122 detects anomalies such as low plunger rise (or fall) velocities along the wellbore or in certain areas. Such anomalies can indicate issues (e.g., corrosion) with the production string, issues with the plunger (e.g., the sealing performance of the plunger being compromised), or issues with another component of the lift system 100 such as the BHBS 124.

The dimensions (e.g., diameter) of the plunger 106 dictate or influence the sealing capability of the plunger 106 against the tubing wall. If the inside diameter of the tubing is uniform (e.g., no tubing damage), the sealing is expected to be generally uniform along the tubing. Although the velocity of the plunger 106 is not always constant, the velocity of plunger 106 is known to increase when the plunger 106 travels to the surface due to gas expansion at a lower pressure. Velocities also differ when the plunger 106 falls through gas or liquid. The computer 122 determines the velocity distribution of the plunger 106 along the tubing, which the computer 122 to detect areas or tubing sections where velocities do not follow the normal trends. Such areas can indicate issues with the sealing performance cause by damage to the tubing or plunger, issues with the clutch mechanism of the plunger, spring issue on a pad plunger, corrosion in the tubing, etc. Detecting such anomalies can help detect issues at an early stage, which can help save time and resources.

Once the computer 122 determines the parameter of the plunger 106 or accumulated fluid "F," the computer compares the parameter with a threshold and adjusts the valve 118 or other components accordingly. For example, once the computer 122 determines the fluid level, the computer 122 compares the fluid level to a fluid level threshold. If the computer 122 determines that the fluid level threshold is met, the computer 122 sends instructions to the controller 120 to open or close the valve 118. For instance, if the threshold indicates that the fluid level is high, the controller can maintain the valve 118 closed longer to increase the shut-in time and thus increase the pressure at the bottom of the wellbore 105 to make sure the pressure will be sufficient to lift the accumulated liquid. Conversely, if the threshold indicates that the fluid level is low, the controller can maintain the valve 118 closed for a shorter period of time so that the pressure at the bottom of the wellbore 105 is just sufficient enough to lift the fluid column. Additionally, the computer 122 can sending instructions to the controller 120 to close the valve 118 sooner so as to decrease the after flow time and decrease the amount of liquid that falls back during the flow time.

In some aspects, the computer 122 determines, along with the liquid level, the volume of liquid fall back and accumulated above the BHBS 124 during the after flow period. Liquid fall back happens during flow period, particularly after the plunger 106 reaches the surface when the gas velocity is no longer sufficient to lift the liquid. The computer 122 uses the liquid level and previous cycle data to optimize the plunger after flow period.

In some aspects, after the plunger 106 lands on the BHBS 124, the wellbore 105 is shut-in to allow gas from the reservoir to percolate into the tubing and the annulus between the tubing and annulus. Gas accumulated in the tubing can result in higher shut-in tubing pressure which leads to the liquid column being displaced back below the BHBS 124 (the BHBS 124 is commonly equipped with a check valve that allows liquid to fall back after the change in pressure exceeds a pre-determined set point). The gas that goes into the annulus increases the annulus pressure to push the plunger 106 and liquid column above the plunger 106 to the surface 103.

In some aspects, one or more RFID tags 114*d* near the surface 113 can be long-range RFID tag so that the RFID reader 121 can detect/interrogate the long-range RFID tag 114*d* from a distance of several feet (e.g., five feet to 300 feet) below the respective long-range RFID tag 114*d*. The wireless transmitter of the plunger 106 transmits, as a function of the data received from the long-range RFID tags 114*d*, information associated with the long-range RFID tags 114*d* to the computer 122. The plunger wirelessly transmits the information to the computer 122 as soon as the RFID reader 121 receives the signal from the RFID tags 114*d* or as soon as the RFID reader 121 comes into range of the computer 122. The computer 122 then computes, based on the data from the RFID tags 114*d*, the approaching speed and/or location of the plunger at a given time. The computer 122 then compares the speed of the plunger to a sped threshold and sends, if the threshold is satisfied, instructions to the controller 120 to cause the controller 120 to close the valve 118 to slow down the plunger 106. The threshold can represent, for example, a speed of the plunger that can damage the lubricator 111.

The computer 122 continues to change and evaluate the shut-in time and after-flow time with respect to the to evaluate the plunger parameters and liquid level of the accumulated liquid "F" to fine-tune the plunger lift cycle. For example, the computer 122 uses historical data of previous plunger lift cycles to predict how changing certain parameters will maximize the production rate. The computer 122 also uses the release time of the plunger 106, the landing time of the plunger 106, and the arrival time of the plunger 106 to determine the duration of the falling period and the duration of the rising period and optimize the cycle based on the falling and rising periods.

In some aspects, the plunger 106 detects the collars 112 without the use of RFID technology. For example, as shown in FIG. 2, the plunger 106 has a plunger body 228 and the collar detecting assembly 204 attached to a downhole end of the plunger body 228. The plunger body 228 has an external diameter similar to an inner diameter of the production string 104 so that the plunger 106 forms a "seal" between fluid above the plunger and fluid below the plunger. For example, the plunger 106 has a spring 226 (or annular ribs) that form the fluid seal with the interior wall of the production string 104. In some cases, some fluid can flow past the plunger in between the outer wall of the plunger 106 and the inner wall of the production string 104 while still allowing the plunger to lift a substantial amount of the fluid above the plunger 106.

Figure 3:
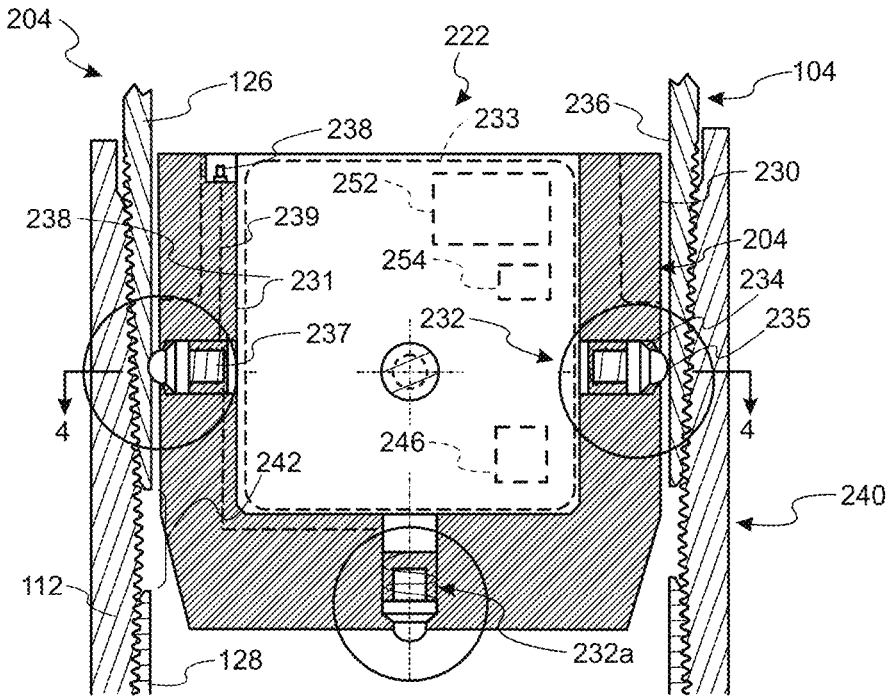
FIG. 3 shows a front cross-sectional view of an example collar detecting assembly above a collar connection.
Figure 4:
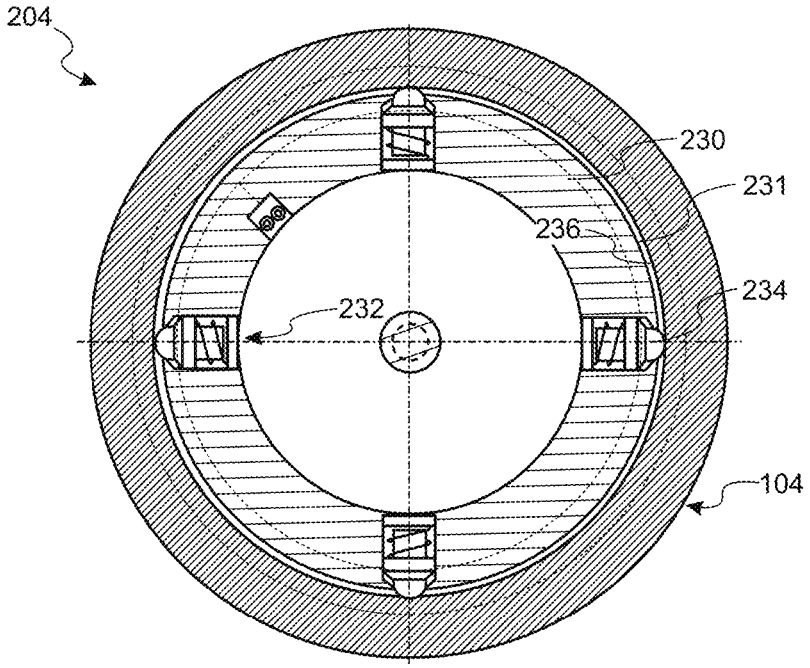
FIG. 4 shows a top, cross-sectional view of the collar detection assembly taken along line 4-4 in FIG. 3.

As shown in FIG. 3, the collar detector 204 (e.g., a mechanical or electromechanical collar detector) includes a housing 230 attached to the plunger body, multiple spring-loaded pins 232 (e.g., spring-loaded plungers), and a circuitry module 222. The circuitry module 222 is disposed within the housing 230. Referring also to FIG. 4, four spring-loaded pins 232 are attached to and extend through a side wall 231 of the housing 230 to bear against an interior wall 236 of the wellbore string 104. The spring-loaded pins 232 include a pin 232 and a spring 237 that pushes the pin 232 toward the wall 236 of the production string 104. For example, the spring-loaded pin can be a type of spring-loaded plunger with a threaded sleeve attached to the housing 230 and an internal spring configured to push the plunger outwardly under a pre-load of the spring.

In some aspects, each side spring-loaded pins 232 are is spaced 90 degrees from one another along the circumference of the housing 230, and the downward-facing spring-loaded pin 232*a* extends through a lowermost surface of the housing 230. Each spring-loaded plunger has an exposed tip 235 that bears against the production string 104 as the plunger moves up and down along the production string 104.

The side spring-loaded pins 232 move axially (are pushed out by their springs) to detect each collar 112. Similarly, the lower spring-loaded pin 232*a* moves axially (is pushed in by the BHBS) to detect when the plunger 106 has arrived at the BHBS 124. For example, as shown in FIG. 3, each joint 240 is formed by two pipes 126, 128 joined by a respective collar 112. The two pipes 126, 128 form an annular gap 242 between their respective rims where the internal surface of the collar 112 is exposed to the collar detector 204. The annular gap 242 has an increased diameter that corresponds with the internal diameter of the collar 112 at its center. The annular gap 242 allows the side spring-loaded pins 232 to extend under the pre-load of the spring 237. Each spring-loaded pin is electrically connected to a transducer 238 (e.g., an electromechanical transduce) through cables 239. The transducer can also act as or include a battery pack connector, connecting the battery pack to the spring-loaded pins 232.

Figure 5:
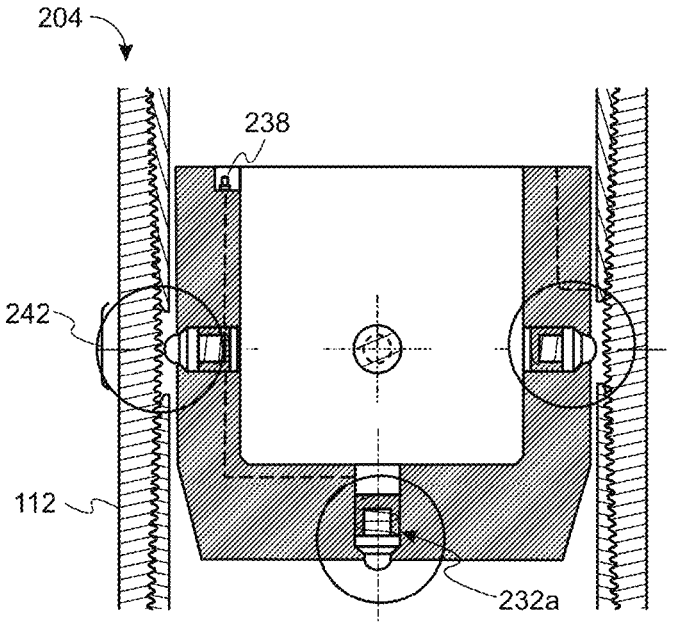
FIG. 5 shows a front cross-sectional view of the collar detecting assembly in FIG. 3, at the collar connection.

As shown in FIG. 5, as the side spring-loaded pins pass through the gap 242, the side spring-loaded pins 232 extend into the gap 242. The transducer 238 converts the axial movement of the side spring-loaded pins 232 into electronic signals. The signals can be timestamps or signals that are converted into timestamps by the transducer or a processor connected to the transducer. For example, as shown in FIG. 3, the collar detector 204 has a circuitry module 222 that includes a power source 233, a processor 252, a transmitter (or transceiver) 254, and a memory 246. The processor 252, a transceiver 254, and memory 246 are powered by the power source 233 and together work to generate, store (in the memory 246), and transmit (e.g., by the transmitter and to the computer 122 at the surface) the timestamps associated with each collar 112.

Figure 6:
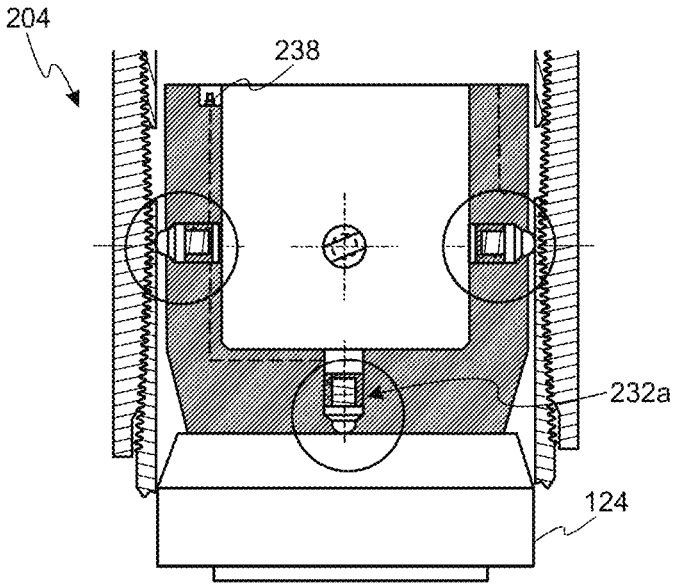
FIG. 6 shows a front cross-sectional view of the collar detecting assembly in FIG. 3, at the bottom hole bumper spring of the wellbore.

As shown in FIG. 6, when the plunger lands on the BHBS 124, the BHBS 124 pushes the spring-loaded pin up, which causes transducer 238 to generate an electrical signal indicative of the plunger arrival time at the BHBS 124. The timestamp of the arrival time at the BHBS 124 is stored in the memory 246 and transmitted to the computer at the surface for the computer to determine, among other things, the falling time period of the plunger 106.

In some aspects, the power source 233 is a battery pack of lithium ion cells snugged in the housing 230 of the collar detector 204. For example, the power source 233 is cylindrically-shaped battery pack disposed within the housing 230 and residing between the spring-loaded pins 234. All or part of the circuitry module 222 (including the power source 233) is also included in the embodiment of the plunger with RFID reader (without the mechanical collar detector 204), the embodiment of the plunger with the mechanical collar detector (without the RFID reader), or an embodiment that combines both the RFID reader and the mechanical collar detector.

The timestamps recorded and stored by the circuitry module 222 are used by the computer in the same ways as described above with respect to FIGS. 1-2 to determine parameters of the plunger and optimize the rate of production of the wellbore. In some cases, both the RFID system described with respect to FIGS. 1-2 and the collar detector can be used simultaneously to add redundancy and thus increase the reliability and availability of the system 100.

Figure 7:
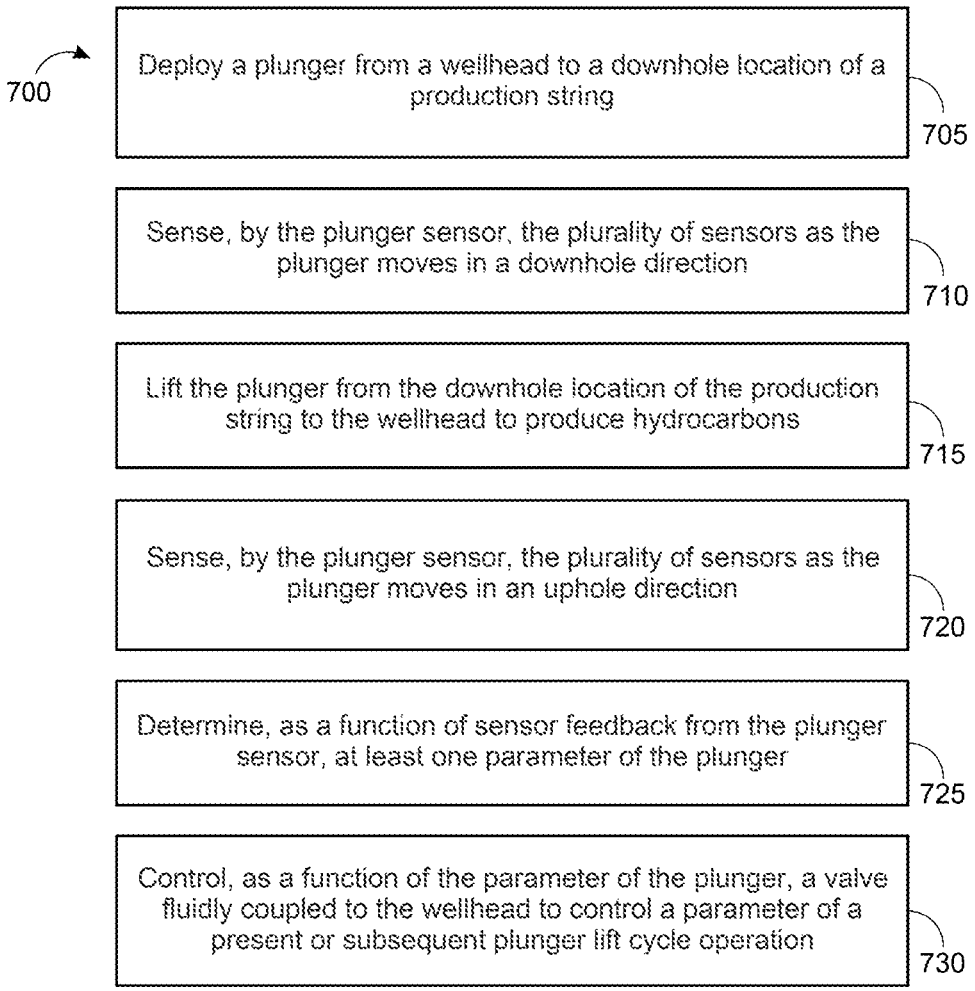
FIG. 7 show a flow chart of an example method of changing a parameter of the plunger lift cycle operation.

FIG. 7 shows a flow chart of a method (700) of changing a parameter of a plunger lift cycle. The method includes deploying a plunger from a wellhead to a downhole location of a production string fluidly coupled to the wellhead and disposed within a wellbore, the plunger comprising a plunger sensor attached to a body of the plunger and the production string comprising a plurality of sensors spaced apart and distributed along a length of the production string (705). The method also includes sensing, by the plunger sensor, the plurality of sensors as the plunger moves in a downhole direction (710). The method also includes lifting the plunger from the downhole location of the production string to the wellhead to produce hydrocarbons (715). The method also includes sensing, by the plunger sensor, the plurality of sensors as the plunger moves in an uphole direction (720). The method also includes determining, as a function of sensor feedback from the plunger sensor, at least one parameter of the plunger (725), and controlling, as a function of the parameter of the plunger, a valve fluidly coupled to the wellhead to control a parameter of a present or subsequent plunger lift cycle operation (730).

Figure 8:
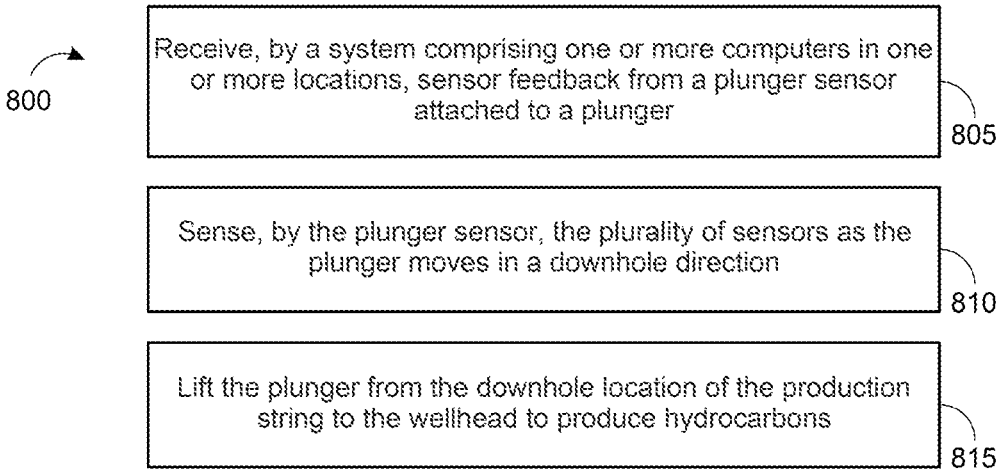
FIG. 8 show a flow chart of an example computer-implemented method of changing a parameter of the plunger lift cycle operation.

FIG. 8 shows a flow chart of a computer-implemented method (800) of changing a parameter of a plunger lift cycle. The method includes receiving, by a system comprising one or more computers in one or more locations, sensor feedback from a plunger sensor attached to a plunger configured to move along a production string to produce hydrocarbons during a plunger lift cycle operation, the production string fluidly coupled to a wellhead comprising a valve and comprising a plurality of spaced apart sensors distributed along a length of the production string, the sensor feedback comprising information gathered from the plurality of sensors (805). The method also includes determining, by the system and as a function of the sensor feedback, a parameter of the plunger along the production string (810). The method also includes controlling, by the system and as a function of the determined parameter, the valve to change at least one parameter of the plunger lift cycle operation (815).

Figure 9:
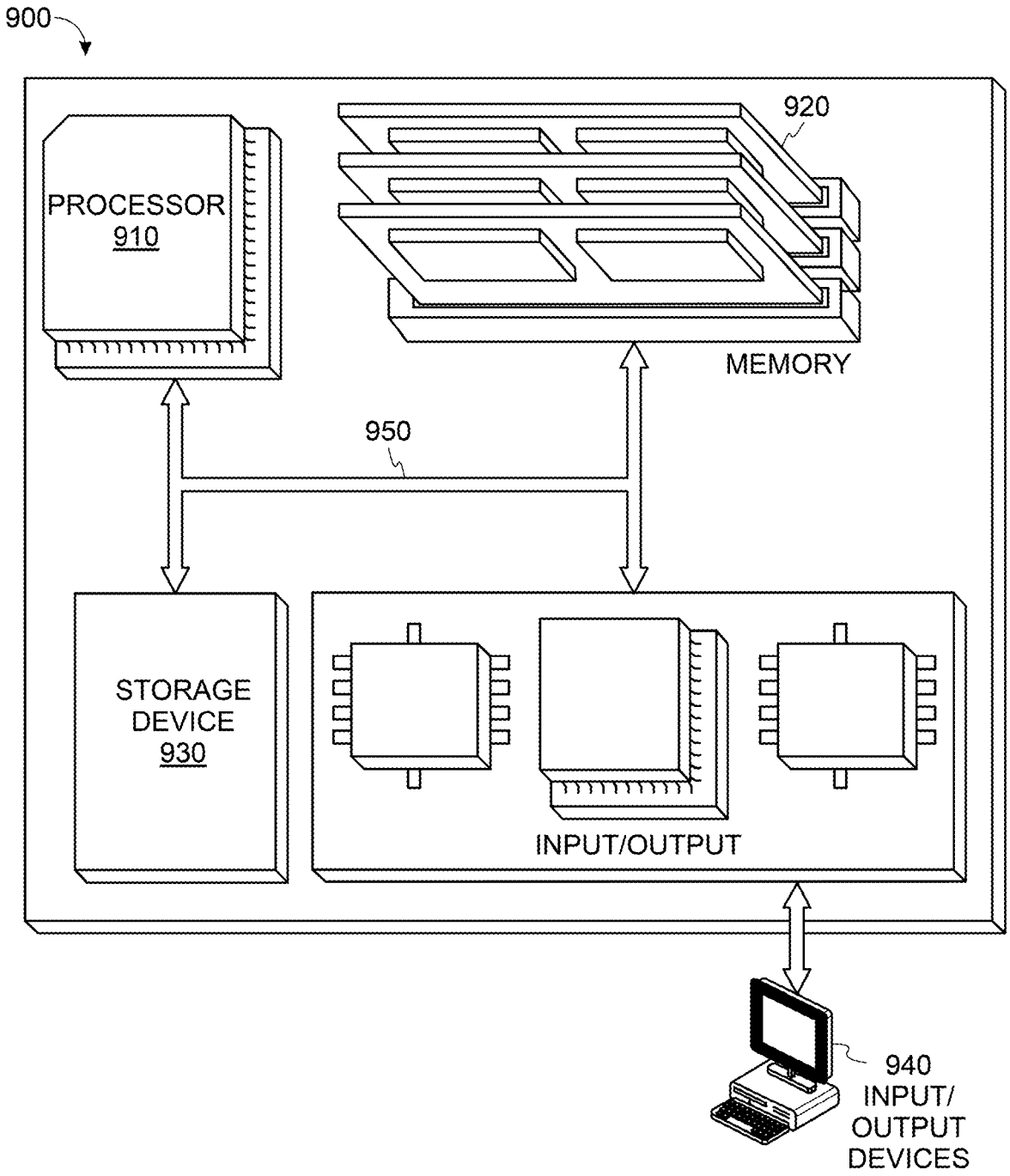
FIG. 9 is a schematic illustration of an example controller (or control system) for a plunger lift system according to an example of the present disclosure.

FIG. 9 is a schematic illustration of an example control system or controller for a plunger lift system according to the present disclosure. For example, the controller 900 may be, include, or be part of the controller 120 shown in FIG. 1. The controller 900 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 900 includes a processor 910, a memory 920, a storage device 930, and an input/output device 940. Each of the components 910, 920, 930, and 940 are interconnected using a system bus 950. The processor 910 is capable of processing instructions for execution within the controller 900. The processor may be designed using any of a number of architectures. For example, the processor 910 may be a CISC (Complex Instruction Set Computers) processor, a RISC (Reduced Instruction Set Computer) processor, or a MISC (Minimal Instruction Set Computer) processor.

In one implementation, the processor 910 is a single-threaded processor. In another implementation, the processor 910 is a multi-threaded processor. The processor 910 is capable of processing instructions stored in the memory 920 or on the storage device 930 to display graphical information for a user interface on the input/output device 940.

The memory 920 stores information within the controller 900. In one implementation, the memory 920 is a computer-readable medium. In one implementation, the memory 920 is a volatile memory unit. In another implementation, the memory 920 is a non-volatile memory unit.

The storage device 930 is capable of providing mass storage for the controller 900. In one implementation, the storage device 930 is a computer-readable medium. In various different implementations, the storage device 930 may be a floppy disk device, a hard disk device, an optical disk device, or a tape device.

The input/output device 940 provides input/output operations for the controller 900. In one implementation, the input/output device 940 includes a keyboard and/or pointing device. In another implementation, the input/output device 940 includes a display unit for displaying graphical user interfaces.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a method includes deploying a plunger from a wellhead to a downhole location of a production string fluidly coupled to the wellhead and disposed within a wellbore. The plunger include a collar detector attached to a body of the plunger and the production string comprising a plurality of collars spaced apart and distributed along a length of the production string, each collar joining two adjacent pipes of the production string to form a joint. The method also includes detecting, by the collar detector, the plurality of collars as the plunger moves in a downhole direction, the detecting comprising generating, by a circuitry module of the collar detector, a first plurality of timestamps each associated with a respective collar. The method also includes lifting the plunger from the downhole location of the production string to the wellhead to produce hydrocarbons. The method also includes detecting, by the collar detector, the plurality of collars as the plunger moves in an uphole direction, the detecting comprising generating, by the circuitry module of the collar detector, a second plurality of timestamps each associated with a respective collar. The method also includes determining, as a function of the first and second plurality of timestamps, at least one parameter of the plunger, and controlling, as a function of the parameter of the plunger, a valve fluidly coupled to the wellhead to control a parameter of a plunger lift cycling operation.

In an example implementation combinable with any other example implementation, the collar detector comprises an electromechanical collar detector comprising a plurality of spring-loaded pins connected to an electromechanical transducer configured to generate, in response to movement of the plurality of spring-loaded pins, the first plurality of timestamps and store the plurality of timestamps in a memory of the plunger, and detecting the plurality of collars as the plunger moves in a downhole direction comprises axially extending, at an annular section of increased diameter at the respective joint, the plurality of spring-loaded pins as the plunger moves past each collar.

In an example implementation combinable with any other example implementation, the method further comprises, before determining the at least one parameter of the plunger, transmitting, by a transmitter of the plunger, the first and second plurality of timestamps to a system comprising one or more computer in one or more location, wherein the determining comprises determining, by the system and as a function of the plurality of timestamps a falling speed of the plunger.

In an example implementation combinable with any other example implementation, the determining includes determining the falling speed of the plunger between two consecutive collars. The determining includes determining, by the system, a time period between the two consecutive collars, and dividing, by the processing device, a prerecorded distance between the two consecutive collars by the time period.

In an example implementation combinable with any other example implementation, the determining includes determining a change of falling speed of the plunger and determining, as a function of the change of falling speed, a fluid level of fluid accumulated at a downhole end of the production string.

In an example implementation combinable with any other example implementation, one of the plurality of spring-loaded pin is a downward facing spring-loaded pin at a lowermost end of the plunger, the downward facing spring-loaded pin configured to retract upon contact with a bottom hole bumper spring of the production spring, the electromechanical transducer configured to generate, in response to the retraction of the downward facing spring-loaded pin, a timestamp that represents a time at which the plunger lands at the bottom hole bumper spring.

In an example implementation combinable with any other example implementation, the controlling comprises controlling a time that the valve is open to decrease or increase a shut-in time of the plunger lift cycle operation to change a production rate of the wellbore.

In an example implementation combinable with any other example implementation, the plurality of spring-loaded pins comprise a plurality of spring-loaded plungers.

In an example implementation combinable with any other example implementation, the determining comprises determining a change of falling or rising speed of the plunger and a location of the falling or rising speed of the plunger and determining, as a function of the change and location of the falling or rising speed, a sealing performance of the plunger.

In an example implementation combinable with any other example implementation, the at least one parameter of the plunger comprises at least one of a falling velocity of the plunger, a falling acceleration of the plunger, a rising velocity of the plunger, a rising acceleration of the plunger, a location of the plunger along the production string, or a location of the plunger within the wellhead.

In an example implementation combinable with any other example implementation, the valve comprises a control valve and the parameter of the subsequent plunger lift cycling operation comprises at least one of a shut-in time or an after-flow time, the controlling comprising controlling a time that the control valve is open to change the shut-in time or the after-flow time and thus change the rate of production of the wellbore.

In an example implementation, a method includes receiving, by a system comprising one or more computers in one or more locations, information from a collar detector attached to a plunger configured to move along a production string to produce hydrocarbons during a plunger lift cycle operation. The production string is fluidly coupled to a wellhead comprising a valve and comprises a plurality of collars spaced apart and distributed along a length of the production string, each collar joining two consecutive pipes of the production string, the information comprising a plurality of timestamps each associated with a time at which the collar detector detects a respective collar. The method also includes determining, by the system and as a function of the information, a parameter of the plunger during the plunger lift cycle operation, and controlling, by the system and as a function of the determined parameter, the valve to change at least one parameter of the plunger lift cycle operation.

In an example implementation combinable with any other example implementation, the collar detector includes a housing attached to a downhole end of the plunger, a memory disposed within the housing, a transducer disposed within the housing, and multiple spring-loaded pins connected to the transducer and extending through a side wall of the housing. The transducer generates, in response to movement of the plurality of spring-loaded pins, the plurality of timestamps and store the plurality of timestamps in the memory, and detecting the plurality of collars as the plunger moves in a downhole direction comprises axially extending, at an annular section of increased diameter at the respective collar, the plurality of spring-loaded pins as the plunger moves past each collar.

In an example implementation combinable with any other example implementation, the method further includes, before determining the parameter of the plunger, transmitting, by a transmitter of the collar detector, the plurality of timestamps to a system at a terranean surface of the wellbore and comprising one or more computer in one or more location, wherein the determining comprises determining, by the system and as a function of the information, a velocity and velocity distribution of the plunger along the production string.

In an example implementation combinable with any other example implementation, the determining comprises determining the falling speed of the plunger between two consecutive collars, the determining comprising determining, by the system, a time period between the two consecutive collars, and dividing, by the processing device, a prerecorded distance between the two consecutive collars by the time period.

In an example implementation combinable with any other example implementation, the determining comprises determining a change of falling speed of the plunger and determining, as a function of the change of falling speed, a fluid level of fluid accumulated at a downhole end of the production string.

In an example implementation combinable with any other example implementation, one of the plurality of spring-loaded pin is a downward facing spring-loaded pin at a lowermost end of the plunger, the downward facing spring-loaded pin configured to retract upon landing at a bottom hole bumper spring of the production spring, the electromechanical transducer configured to generate, in response to the retraction of the downward facing spring-loaded pin, a timestamp that represents a time at which the plunger landed at the bottom hole bumper spring.

In an example implementation combinable with any other example implementation, the controlling includes controlling a time that the valve is open to decrease or increase a shut-in time of the plunger lift cycle operation to change a production rate of the wellbore.

In an example implementation, a plunger lift system comprises a production string configured to be disposed within a wellbore, the production string made of a plurality of pipes joined by a plurality of collars, a wellhead configured to reside at a terranean surface of the wellbore and be fluidly coupled to the production string, a valve configured to be fluidly coupled to the wellhead, a plunger configured to move along the production string to produce hydrocarbons during a plunger lift cycle operation, the plunger comprising a collar detector, and a system at or near the terranean surface of the wellbore. The system comprises one or more computers in one or more locations. The system is configured to receive, from the collar detector, information comprising a plurality of timestamps each representing a time at which the collar detector detected a respective one of the plurality of collars, and determine, as a function of the information, a parameter of the plunger, the parameter comprising at least one of a speed or location of the plunger along the production string, the parameter usable to control the at least one parameter of the plunger lift cycle operation.

In an example implementation combinable with any other example implementation, the system includes a controller configured to control, as a function of the determined speed of the plunger, the valve to change at least one of a shut-in period or an after-flow period of the plunger lift cycle operation.

What is claimed is:

1. A method, comprising:

receiving, by a system comprising one or more computers in one or more locations, information from a collar detector attached to a plunger configured to move along a production string to produce hydrocarbons during a plunger lift cycle operation, the production string fluidly coupled to a wellhead comprising a valve, the production string comprising a plurality of collars spaced apart and distributed along a length of the production string, each collar joining two consecutive pipes of the production string, the information comprising a plurality of timestamps each associated with a time at which the collar detector detects a respective collar;

determining, by the system and as a function of the information, a parameter of the plunger during the plunger lift cycle operation; and controlling, by the system and as a function of the determined parameter, the valve to change at least one parameter of the plunger lift cycle operation;

wherein one of a plurality of spring-loaded pins is a downward facing spring-loaded pin at a lowermost end of the plunger, the downward facing spring-loaded pin configured to retract upon landing at a bottom hole bumper spring of the production spring, and the collar detector is configured to generate, in response to the retraction of the downward facing spring-loaded pin, a timestamp that represents a time at which the plunger landed at the bottom hole bumper spring.

2. A method, comprising:

deploying a plunger from a wellhead to a downhole location of a production string fluidly coupled to the wellhead and disposed within a wellbore, the plunger comprising a collar detector attached to a body of the plunger and the production string comprising a plurality of collars spaced apart and distributed along a length of the production string, each collar joining two adjacent pipes of the production string to form a joint;

detecting, by the collar detector, the plurality of collars as the plunger moves in a downhole direction, the detecting comprising generating, by a circuitry module of the collar detector, a first plurality of timestamps each associated with a respective collar;

lifting the plunger from the downhole location of the production string to the wellhead to produce hydrocarbons;

detecting, by the collar detector, the plurality of collars as the plunger moves in an uphole direction, the detecting comprising generating, by the circuitry module of the collar detector, a second plurality of timestamps each associated with a respective collar;

determining, as a function of the first and second plurality of timestamps, at least one parameter of the plunger; and controlling, as a function of the parameter of the plunger, a valve fluidly coupled to the wellhead to control a parameter of a plunger lift cycling operation;

wherein the collar detector comprises an electromechanical collar detector comprising a plurality of spring-loaded pins connected to an electromechanical transducer configured to generate, in response to movement of the plurality of spring-loaded pins, the first plurality of timestamps and store the plurality of timestamps in a memory of the plunger, and detecting the plurality of collars as the plunger moves in a downhole direction comprises axially extending, at an annular section of increased diameter at the respective joint, the plurality of spring-loaded pins as the plunger moves past each collar.

3. The method of claim 2, further comprising, before determining the at least one parameter of the plunger, transmitting, by a transmitter of the plunger, the first and second plurality of timestamps to a system comprising one or more computer in one or more location, wherein the determining comprises determining, by the system and as a function of the plurality of timestamps a falling speed of the plunger.

4. The method of claim 3, wherein the determining comprises determining the falling speed of the plunger between two consecutive collars, the determining comprising:

determining, by the system, a time period between the two consecutive collars, and dividing, by the system, a prerecorded distance between the two consecutive collars by the time period.

5. The method of claim 4, wherein the determining comprises determining a change of falling speed of the plunger and determining, as a function of the change of falling speed, a fluid level of fluid accumulated at a downhole end of the production string.

6. The method of claim 2, wherein one of the plurality of spring-loaded pin is a downward facing spring-loaded pin at a lowermost end of the plunger, the downward facing spring-loaded pin configured to retract upon contact with a bottom hole bumper spring of the production spring, the electromechanical transducer configured to generate, in response to the retraction of the downward facing spring-loaded pin, a timestamp that represents a time at which the plunger lands at the bottom hole bumper spring.

7. The method of claim 2, wherein the controlling comprises controlling a time that the valve is open to decrease or increase a shut-in time of the plunger lift cycling operation to change a production rate of the wellbore.

8. The method of claim 2, wherein the plurality of spring-loaded pins comprise a plurality of spring-loaded plungers.

9. The method of claim 2, wherein the at least one parameter of the plunger comprises at least one of a falling velocity of the plunger, a falling acceleration of the plunger, a rising velocity of the plunger, a rising acceleration of the plunger, a location of the plunger along the production string, or a location of the plunger within the wellhead.

10. The method of claim 2, wherein the valve comprises a control valve and the parameter of a subsequent plunger lift cycling operation comprises at least one of a shut-in time or an after-flow time, the controlling comprising controlling a time that the control valve is open to change the shut-in time or the after-flow time and thus change the rate of production of the wellbore.

11. A method, comprising:

receiving, by a system comprising one or more computers in one or more locations, information from a collar detector attached to a plunger configured to move along a production string to produce hydrocarbons during a plunger lift cycle operation, the production string fluidly coupled to a wellhead comprising a valve, the production string comprising a plurality of collars spaced apart and distributed along a length of the production string, each collar joining two consecutive pipes of the production string, the information comprising a plurality of timestamps each associated with a time at which the collar detector detects a respective collar;

determining, by the system and as a function of the information, a parameter of the plunger during the plunger lift cycle operation; and controlling, by the system and as a function of the determined parameter, the valve to change at least one parameter of the plunger lift cycle operation;

wherein the collar detector comprises:

a housing attached to a downhole end of the plunger;

a memory disposed within the housing;

a transducer disposed within the housing; and a plurality of spring-loaded pins connected to the transducer and extending through a side wall of the housing, the transducer configured to generate, in response to movement of the plurality of spring-loaded pins, the plurality of timestamps and store the plurality of timestamps in the memory, and detecting the plurality of collars as the plunger moves in a downhole direction comprises axially extending, at an annular section of increased diameter at the respective collar, the plurality of spring-loaded pins as the plunger moves past each collar.

12. The method of claim 11, further comprising, before determining the parameter of the plunger, transmitting, by a transmitter of the collar detector, the plurality of timestamps to a system at a terranean surface of the wellbore and comprising one or more computer in one or more location, wherein the determining comprises determining, by the system and as a function of the information, a velocity and velocity distribution of the plunger along the production string.

13. The method of claim 11, wherein the determining comprises determining the falling speed of the plunger between two consecutive collars, the determining comprising:

determining, by the system, a time period between the two consecutive collars, and dividing, by the system, a prerecorded distance between the two consecutive collars by the time period.

14. The method of claim 13, wherein the determining comprises determining a change of falling speed of the plunger and determining, as a function of the change of falling speed, a fluid level of fluid accumulated at a downhole end of the production string.

15. The method of claim 11, wherein the controlling comprises controlling a time that the valve is open to decrease or increase a shut-in time of the plunger lift cycle operation to change a production rate of the wellbore.

16. A plunger lift system, comprising:

a production string configured to be disposed within a wellbore, the production string made of a plurality of pipes joined by a plurality of collars;

a wellhead configured to reside at a terranean surface of the wellbore and be fluidly coupled to the production string;

a valve configured to be fluidly coupled to the wellhead;

a plunger configured to move along the production string to produce hydrocarbons during a plunger lift cycle operation, the plunger comprising a collar detector; and a system at or near the terranean surface of the wellbore, the system comprising one or more computers in one or more locations, the system configured to:

receive, from the collar detector, information comprising a plurality of timestamps each representing a time at which the collar detector detected a respective one of the plurality of collars; and determine, as a function of the information, a parameter of the plunger, the parameter comprising at least one of a speed or location of the plunger along the production string, the parameter usable to control at least one parameter of the plunger lift cycle operation;

wherein the collar detector comprises an electromechanical collar detector comprising a plurality of spring-loaded pins connected to an electromechanical transducer configured to generate, in response to movement of the plurality of spring-loaded pins, the plurality of timestamps and store the plurality of timestamps in a memory of the plunger, the collar detector configured to detect the plurality of collars as the plurality of spring-loaded pins extend at an annular section of increased diameter at the respective joint as the plunger moves past each collar.

17. The plunger lift system of claim 16, wherein the system comprises a controller configured to control, as a function of the determined speed of the plunger, the valve to change at least one of a shut-in period or an after-flow period of the plunger lift cycle operation.

18. A method, comprising:

deploying a plunger from a wellhead to a downhole location of a production string fluidly coupled to the wellhead and disposed within a wellbore, the plunger comprising a collar detector attached to a body of the plunger and the production string comprising a plurality of collars spaced apart and distributed along a length of the production string, each collar joining two adjacent pipes of the production string to form a joint;

detecting, by the collar detector, the plurality of collars as the plunger moves in a downhole direction, the detecting comprising generating, by a circuitry module of the collar detector, a first plurality of timestamps each associated with a respective collar;

lifting the plunger from the downhole location of the production string to the wellhead to produce hydrocarbons;

detecting, by the collar detector, the plurality of collars as the plunger moves in an uphole direction, the detecting comprising generating, by the circuitry module of the collar detector, a second plurality of timestamps each associated with a respective collar;

determining, as a function of the first and second plurality of timestamps, at least one parameter of the plunger; and controlling, as a function of the parameter of the plunger, a valve fluidly coupled to the wellhead to control a parameter of a plunger lift cycling operation;

wherein the determining comprises determining a change of falling or rising speed of the plunger and a location of the falling or rising speed of the plunger and determining, as a function of the change and location of the falling or rising speed, a sealing performance of the plunger.

* * * * *